US005295695A

United States Patent [19]

Tamanini

[11] Patent Number: 5,295,695

[45] Date of Patent: Mar. 22, 1994

[54] METHOD OF CODING GIFTS

[76] Inventor: Vicki L. Tamanini, 5039 Dante Ave., Vineland, N.J. 08360

[21] Appl. No.: 50,584

[22] Filed: Apr. 22, 1993

[51] Int. Cl.[5] ..... A63F 9/00

[52] U.S. Cl. ..... 273/459; 283/70; 283/81; 283/87; 434/331

[58] Field of Search ..... 273/459; 283/70, 74, 283/75, 81, 90, 91, 87; 434/331

[56] References Cited

U.S. PATENT DOCUMENTS

| | | | |
|---|---|---|---|
| 2,274,342 | 2/1942 | Ormsby | 273/1 |
| 2,635,881 | 4/1953 | Cooney | 273/153 |
| 2,876,012 | 3/1959 | Allen | 273/153 |
| 3,223,421 | 12/1965 | Hershkowitz | 273/139 |
| 3,281,960 | 11/1966 | Gross | 424/331 |
| 3,556,528 | 1/1971 | Spiring | 273/134 |
| 3,755,934 | 9/1973 | Porcher et al. | 283/81 X |
| 3,787,050 | 1/1974 | Goldfarb | 273/1 |
| 4,034,987 | 7/1977 | Kelly | 273/137 |
| 4,180,284 | 12/1979 | Ashley | 283/74 |
| 4,235,459 | 11/1980 | Callahan | 283/81 X |
| 4,951,969 | 8/1990 | Epstein et al. | 283/81 |
| 5,058,959 | 10/1991 | Miles et al. | 283/81 X |
| 5,236,200 | 8/1993 | McGregor et al. | 273/459 |

FOREIGN PATENT DOCUMENTS 194875A of 0000 European Pat. Off. .

OTHER PUBLICATIONS

Games Magazine Apr./May 1987 p. 39.

*Primary Examiner*—Paul E. Shapiro
*Attorney, Agent, or Firm*—Thomas A. Lennox

[57] ABSTRACT

A method of coding gifts including a set of stickers all with one symbol which are attached to gifts with a card given to the child identifying the symbol and indicating that all gifts with that symbol belong to that child. Clue cards are used to allow the child to locate the identifying card and colored filter decoders are used to uncover the symbol on camouflaged stickers.

17 Claims, 2 Drawing Sheets

METHOD OF CODING GIFTS

BACKGROUND OF THE INVENTION

This invention involves a method of coding gifts and then apprising the child which code identifies that child's gifts. This invention also involves a method of play to allow the child to seek and determine the particular code or codes that have been placed on that child's gifts.

A young child may understand the gift giving process on holidays long before that child is able to read. In a somewhat other vein, older children are unable to wait for the holiday and are tempted to peek inside those packages with their name on them. For all involved, including the parents, even where the child is older, the opening of the gifts is over too quickly leaving the children and the parents unsatisfied.

In U.S. Pat. No. 2,876,012 to F. J. Allen, Jr., matching games are described using puzzle pieces which are matched to a game board which identifies a prize on a prize list. U.S. Pat. Nos. 2,274,342 to L. D. Ormsby and 2,635,881 to R. B. Cooney describe games, fixtures and word clues on separate pieces of paper. Other games using cards are described in U.S. Pat. Nos. 3,556,528 to James Christopher Spiring; 3,787,050 to Adolph E. Goldfarb; and European Patent Office disclosure number 194-875-A to R. E. Dvorak. U.S. Pat. No. 3,223,421 to P. Hershkowitz describes a color coded game card and U.S. Pat. No. 4,034,987 to George J. Kelly describes a game having position-denoting indicia thereon. A game is described in the 1987 April/May issue of Games Magazine wherein hidden treasure is located using clues in a book and home video.

None of these games or disclosures solve the problems associated with the gift giving process as described above. Further, none of these prior games are directed to that problem nor do they suggest ways of meeting the problems. In addition, none of these games of devices attain the objects of this invention described hereinbelow.

SUMMARY OF THE INVENTION

The use of this invention is particularly suitable for holidays including but not limited to Christmas, Easter, birthdays or any of the other religious holidays where gift giving has become a tradition. A key element of the present invention is the coding of the gifts for a particular child. While a single code can be used for that child, the method also includes applying two or more codes to portions of the gifts for a particular child. The invention is particularly effective when there is more than one child involved such that a different code or different codes are used on the gifts for the second child.

It is an object of an aspect of the present invention to provide a coding system which will be easily and readily identified by even the smallest of children, even if they cannot read.

It is a further object of an aspect of the present invention to provide a coding system which will deter older children from determining in advance which packages are theirs and what gifts they have received even though the wrapped gifts are displayed prior to the holiday.

It is an additional object of an aspect of the present invention to provide a system of coding the gifts to a particular child with a series of codes making it more difficult to determine to whom the gift belongs.

It is a further object of an aspect of the present invention to provide a coding system that can be utilized in a method to use the skill or knowledge of the child to determine which code or codes identify their gifts.

It is a particular object of an aspect of the present invention to provide a method which will lengthen the gift opening process at holiday time, prolonging the enjoyment and thrill of giving and receiving gifts.

An aspect of the invention is a method to aid children to identify their multiple gifts from the multiple gifts of others at a chosen time of giving. The method includes providing a first coding means that includes a multiplicity of sheet members each including a front surface and rear surface, adhesive means on each sheet to cause the rear surface to adhere to a gift, and a first marking means visible on the front surface of each sheet making all the sheet members of the first coding means identifiable as single group to a child. The method further includes providing a second coding means that includes a multiplicity of sheet members each including a front surface and a rear surface, second adhesive means on each sheet to cause the rear surface to adhere to a gift, and second marking means visible on the front surface of each sheet making all the sheet members of the second coding means identifiable as single group to a child and distinguishable from the first coding means. The method further includes providing first matching means that includes information that matches the first marking means with a first child and second matching means that includes information that matches the second marking means with a second child. The method further includes adhering first coding means to at least a potion of gifts intended for the first child and adhering second coding means to at least a portion of gifts intended for the second child. The method further includes that at a chosen time for giving the gifts delivering the first coding means to the first child and the second coding means to the second child.

It is preferred that the method further include providing a third coding means that includes a multiplicity of sheet members each includes a front surface and a rear surface, adhesive means on each sheet to cause the rear surface to adhere to a gift, and a third marking means visible on the front surface of each sheet making all the sheet members of the third coding means identifiable as single group to a child and distinguishable from all other coding means. The preferred method further includes providing a fourth coding means that includes a multiplicity of sheet members each includes a front surface and a rear surface, adhesive means on each sheet to cause the rear surface to adhere to a gift, and a fourth marking means visible on the front surface of each sheet making all the sheet members of the fourth coding means identifiable as single group to a child and distinguishable from all other coding means. The preferred method further includes providing third matching means that includes information that matches the third marking means with the first child, and providing fourth matching means that includes information that matches the fourth marking means with the second child. The preferred method further includes applying third coding means to a balance of gifts intended for the first child and applying fourth coding means to a balance of gifts intended for the second child. The preferred method further includes that, at a chosen time for giving the gifts, delivering the third matching means to the first child and the fourth matching means to the second child.

Another preferred method further includes that prior to the chosen time for giving the gifts hiding the first and second matching means in separate locations, providing first clue means that includes information with at least one clue that guides the first child to find the first matching means, and providing second clue means that includes information with at least one clue that guides the first child to find the first matching means. The preferred method further includes that at the chosen time the delivering the first matching means to the first child and the second matching means to the second child be accomplished by delivering the first clue means to the first child and the second clue means to the second child.

It is further preferred that the first and second clue means each include cards that contain information as to where the respective matching means are located. It is further preferred that the first, second, third and fourth clue means each include cards that contain information as to where the respective matching means are located. It is further preferred that the first and second matching means each include cards that contain information identifying the marking means and matching it to a respective child. It is more preferred that the first, second, third, and fourth matching means each include cards that contain information identifying the marking means and matching it to a respective child. It is further preferred that the adhesive means causes each sheet to adhere to a gift on contact, and the adhering includes pressing the sheet members against a surface of the gift. It is further preferred that each matching means includes decoding means that includes a colored transparent filter and each coding means includes a camouflaging pattern printed over the marking means making identification of the marking means essentially impossible with an unaided eye, wherein the hues of the camouflaging pattern and the color of the filter are the same and the hues of the marking means and the color of the filter are contrasting, and the method further includes aligning the filter of the decoding means over coding means and identifying the coding means through the filter. It is further preferred that the sheet members be all paper or plastic film contact adhesively individually attached to and spaced apart on an adhesive releasable sheet, and applying coding means includes peeling the sheets from the releasable sheet. It is further preferred that the first matching means includes a first card containing information that matches the first marking means with a first child also includes an envelope, and the method further includes affixing the first child's name on the outside of the envelope, inserting the first card into the envelope and sealing the envelope, the second matching means includes a second card containing information that matches the second marking means with a second child also includes an envelope, and the method further includes affixing the second child's name on the outside of the envelope, inserting the second card into the envelope and sealing the envelope.

Another aspect of the invention is another method to aid children to identify their multiple gifts from the multiple gifts of others at a chosen time of giving. The method includes providing a first coding means that includes a multiplicity of sheet members each including a front surface and a rear surface, adhesive means on each sheet to cause the rear surface to adhere on contact to a gift, and a first marking means visible on the front surface of each sheet making all the sheet members of the first coding means identifiable as single group to a child. The method further includes providing a second coding means that includes a multiplicity of sheet members each including a front surface and a rear surface, second adhesive means on each sheet to cause the rear surface to adhere on contact to a gift, and a second marking means visible on the front surface of each sheet making all the sheet members of the second coding means identifiable as single group to a child and distinguishable from the first coding means. The method further includes adhering first coding means to at least a portion of gifts intended for the first child and adhering second coding means to at least a portion of gifts intended for the second child. The method further includes providing first matching means that includes a card that contains information that matches the first marking means with a first child, and providing second matching means that includes a card that contains information that matches the second marking means with a second child. The method further includes that prior to a chosen time for giving the gifts hiding the first and second matching means in separate locations. The method further includes providing first clue means that includes a card that contains information with at least one clue that guides the first child to find the first matching means, and providing second clue means that includes a card that contains information with at least one clue that guides the first child to find the first matching means. The method further includes that at the chosen time for giving the gifts delivering the first clue means to the first child and the second clue means to the second child.

Yet another aspect of the invention is another method to aid children to identify their multiple gifts from the multiple gifts of others at a chosen time of giving. The method incudes providing first coding means that includes a multiplicity of sheet members each includes a front surface and a rear surface, adhesive means on each sheet to cause the rear surface to adhere on contact to a gift, a first marking means on the front surface of each sheet making all the sheet members of the first coding means identifiable as single group to a child, and a camouflaging pattern printed over the first marking means making identification of the first marking means essentially impossible with an unaided eye. The method further includes providing a second coding means that includes a multiplicity of sheet members each includes a front surface and a rear surface, second adhesive means on each sheet to cause the rear surface to adhere on contact to a gift, a second marking means on the front surface of each sheet making all the sheet members of the second coding means identifiable as single group to a child and distinguishable from the first coding means, and a camouflaging pattern printed over the second marking means making identification of the second marking means essentially impossible with an unaided eye. The method further includes adhering first coding means to at least a portion of gifts intended for the first child and adhering second coding means to at least a portion of gifts intended for the second child. The method further includes providing first matching means that includes a card that contains information that matches the first marking means with a first child, and decoding means that includes a colored transparent filter, wherein the hues of the camouflaging pattern of the first coding means and the color of the filter are the same and the hues of the first marking means and the color of the filter are contrasting. The method further includes providing second matching means that includes a card that contains information that matches the second marking means with a second child, and decoding means that includes a colored transparent filter, wherein the hues of the camouflaging pattern of the second coding means and the color of the filter are the same and the hues of the second marking means and the color of the filter are contrasting. The method further includes that prior to the chosen time for giving the gifts, hiding the first and second matching means in separate locations. The method further includes providing first clue means that includes a card that contains information with at least one clue that guides the first child to find the first matching means. The method further includes at a chosen time for giving the gifts delivering the first clue means to the first child and the second clue means to the second child.

Another aspect of the invention is a method to aid children to identify their multiple gifts from the multiple gifts of others at a chosen time of giving. The method includes providing a first coding means that includes a multiplicity of sheet members each including a front surface and a rear surface and adhesive means on each sheet to cause the rear surface to adhere on contact to a gift. The first coding means further includes a first marking means visible on the front surface of each sheet making all of the sheet members of the first coding means identifiable as single group to a child. The method further includes providing means that includes a first card containing information that matches the first marking means with a first child and applying first coding means to at least a portion of gifts intended for the first child. The method then includes that at a chosen time for receiving the gifts delivering the first card to the first child.

A preferred method of the above method further includes providing a second coding means that includes a multiplicity of sheet members each including a front surface and a rear surface and adhesive means on each sheet to cause the rear surface to adhere on contact to a gift. The second coding means further includes a second marking means visible on the front surface of each sheet making all the sheet members of the second coding means identifiable as single group to a child and distinguishable from the first coding means. This preferred method further includes applying second coding means to at least a portion of gifts intended for the second child, and at the chosen time for receiving the gifts also delivering the second card to the second child.

A more preferred method of the above method further includes providing a third coding means that includes a multiplicity of sheet members each comprising a front surface and a rear surface and adhesive means on each sheet to cause the rear surface to adhere on contact to a gift. The third coding means further includes a third marking means visible on the front surface of each sheet making all the sheet members of the third coding means identifiable as single group to a child and distinguishable from both the first and second coding means. The more preferred method further includes providing means that includes a third card containing information that matches the third marking means with a third child, applying third coding means to at least a portion of gifts intended for the third child, and at the chosen time for receiving gifts also delivering the third card to the third child.

DESCRIPTION OF PREFERRED EMBODIMENTS

Figure 1:
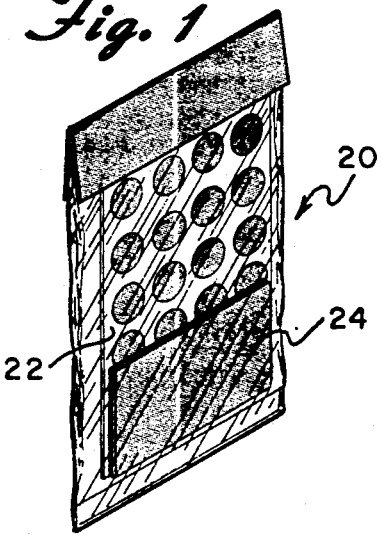
FIG. 1 is a perspective view of a package of the materials provided in the method of this invention.
Figure 2:
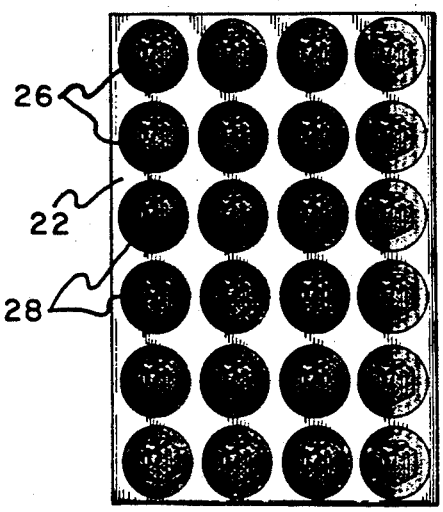
FIG. 2 is a top view of a release sheet of sticker sheet members used therein.
Figure 3:
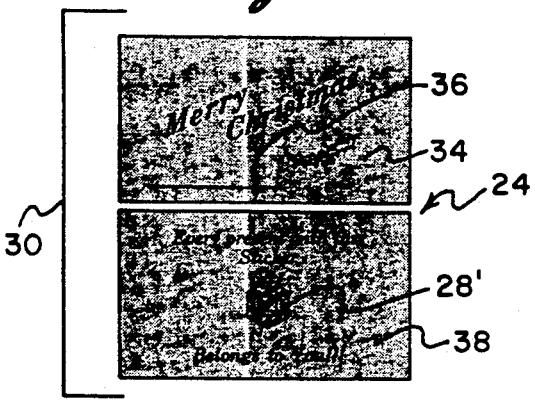
FIG. 3 is a diagram showing the front and inside of a card used therein.
Figure 4:
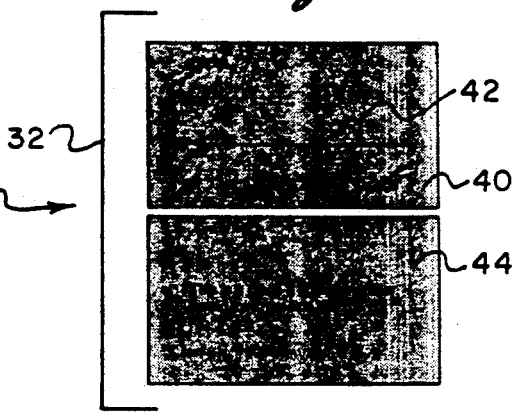
FIG. 4 is a diagram showing the front and inside of a clue card used therein this invention.
Figure 5:
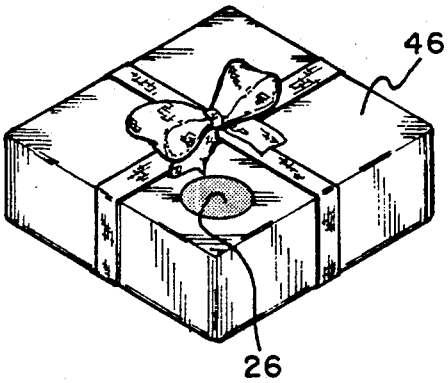
FIG. 5 is a top perspective view of a package on which a sticker sheet member is affixed.
Figure 6:
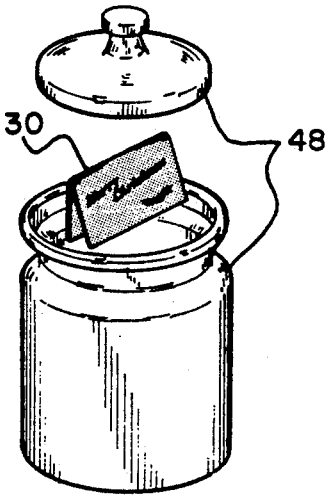
FIG. 6 is a perspective view of a cookie jar into which the card diagramed in FIG. 3 is placed.
Figure 7:
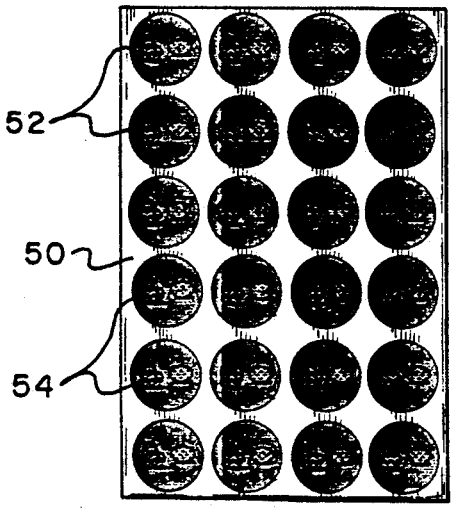
FIG. 7 is a top view of a sheet of sticker sheet members used in a second embodiment of the present invention.
Figure 8:
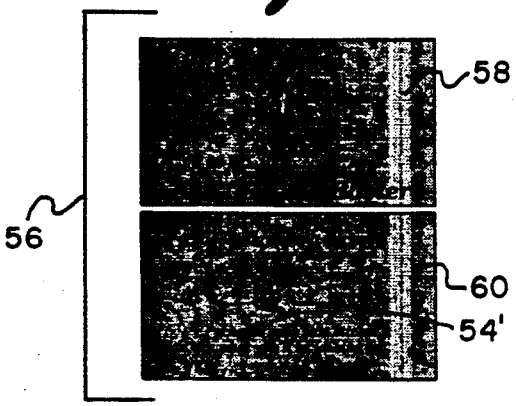
FIG. 8 is a diagram of the front and inside of a card used therein.

A method of the present invention is illustrated in FIGS. 1 through 6 wherein package 20 encloses a kit containing items to carry out the invention including release sheet 22 on which adhesive stickers 26 are spaced on the release surface together with cards 24 utilized in the method. All stickers 26 have a symbol, such as the wrapped package symbol displayed on each sticker 26. The stickers may be constructed of paper or plastic film with a contact adhesive on a rear surface abutting the release paper 22. The symbol may be chosen to suit the particular occasion or may be a mere pattern so long as it is sufficiently distinctive to allow a child to distinguish between a symbol assigned to him or her from symbols assigned to other children. Color is an effective symbol and may be used alone or in combination with a small diagram such as shown in FIG. 2. The shading is used to merely indicate any color and is not intended to depict any particular hue. Card 30 is diagramed in FIG. 3 it being a folded card attached at their upper edges of the surfaces shown. Front surface 34 contains a greeting of the occasion together with a line on which the name of the chosen child is affixed. Inside surface 38 of card 30 indicates that each present for that particular child has a sticker with symbol 28' affixed. An alternative method is to merely affix one of the stickers 26 to the card at that location. As an optional addition, card 32 is provided to give a clue as to the location of card 30 which is hidden in this case in cookie jar 48 as illustrated in FIG. 6. Card 32 is also a folded card attached along the upper edges of sections 40 and 44. Front section 40 includes line 42 on which the chosen child's name is affixed to avoid an error in giving out the cards. The affixing of the child's name on line 36 of card 30 avoids the possibility of another child inadvertently finding the hidden card and incorrectly identifying his or her sticker symbol. On inside surface 44 of card 32 a clue is provided as to the location of card 30. The method is carried out by affixing one sticker 26 on each package 46 for the first child. Card 30 is then hidden in the location for which the clue on card 32 indicates the symbol identifying card should be hidden. Clue cards 32 are either delivered directly to the child, or placed in a conspicuous place so that the child will immediately find his or her clue card. clue cards can provide any number of simple clues for locating card 30 such as "look in place that makes food hot" for oven or microwave, "this is a place a cookie monster would love" for cookie jar 48, "this plays our favorite movies" for VCR or TV, and "you'll get a kiss under this" for mistletoe. The first child using clue card 32 or series of clue cards finally locates card 30 which indicates that every present with the chosen symbol 28' belongs to the first child. The method is enhanced with a plurality or multiplicity of children all participating at the same time. Symbols are unique for each child, although it is quite appropriate and effective to have two different symbols affixed to presents of a single child. Thus, with two children involved, two symbols may be assigned to one child and two different symbols assigned to the second child. With this later method, each child must use two clue cards or two series of clue cards to locate their symbol identifying cards which identify the symbols as identifying part of the presents for that child.

Figure 9:
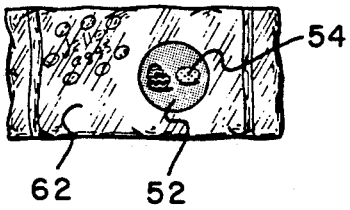
FIG. 9 is a perspective view of a candy package on which a single sticker sheet member is affixed therein.
Figure 10:
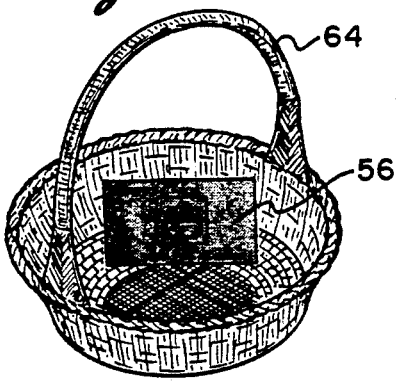
FIG. 10 is a perspective view of a basket into which the card diagramed in FIG. 9 has been placed.
Figure 11:
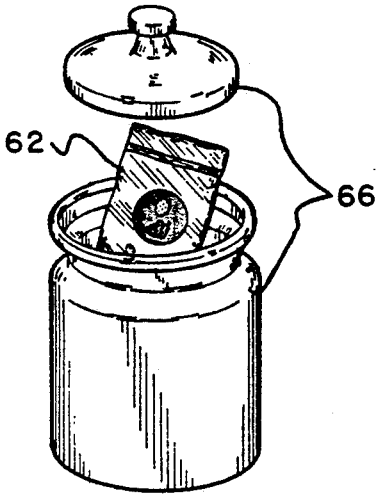
FIG. 11 is a perspective view of a candy jar in which the package illustrated in FIG. 10 is hidden.

A second embodiment is illustrated in FIGS. 7 through 11 wherein the components of the kit are supplied in a package similar to that of package 20 although this particular kit is directed to the Easter holiday. In this method, release paper sheet 50 has a multiplicity of stickers 52 attached on its release surface, each sticker having a distinctive symbol on each sticker. In this case, the Easter eggs on a chosen color background identify all the candy for a particular child. Particularly for the Easter holidays, colored circles without a printed drawing are quite effective as "eggs" to identify a particular child's candy. Card 56 is placed in a basket 64 which the child recognizes, is hand delivered to the child, or has the child's name affixed to the basket or to the card. Card 56 is a folded card with the upper edges of the two diagramed faces connected having front face 58 with a holiday greeting and inside face 60 containing a message indicating that hidden throughout the house is candy, eggs, or packages with a sticker having symbol 54' thereon is what the child is looking for. The method then includes adhering stickers 52 with symbol 54 readily visible to candy package 62 as shown in FIG. 9 and all other candy or containers holding the candy for that particular child. The candy is then hidden throughout the house and yard such as in cookie jar 66 into which candy package 62 is hidden. Again, multiple symbols may be used for a single child and multiple children can participate at the same time without worrying that the older child will receive a larger portion of the hidden candy or eggs because of superior developed skills.

Figure 12:
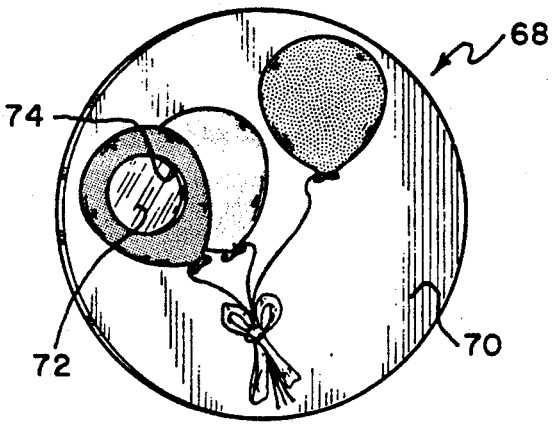
FIG. 12 is a perspective view of a decoding device used in a third embodiment of the invention.

A third embodiment is illustrated in FIG. 12 and is utilized in conjunction with matching cards such as cards 30 and 56. The modified cards indicate that the sticker attached to the card requires a special decoding device and provides clues as to the location of that decoding device. The stickers in this embodiment are imprinted in at least two colors. One contrasting color being that of an easily recognizable symbol and the second color in a "camouflaged" pattern which makes it essentially impossible to recognize the symbol in white light. A decoding device is a colored filter of a matching hue to the camouflaging printing and which brings the symbol to a darkened hue when viewed through the filter. A common example of these color combinations is a print of the symbol in blue ink and the camouflaging pattern in red ink. By using a red filter, the camouflaging effect of the pattern is eliminated and viewing the blue symbol through the red filter darkens the symbol so that it can easily be recognized. Although all of the decoding devices may be identical, other color combinations and other colored filters may be utilized for different children. Coding device 68 is illustrated in FIG. 12 which includes cardboard or plastic frame 70 onto which is fixed red transparent filter 72 over hole 74 so that the child can easily align the filter over the sticker and read the symbol. An example of the use of this method is a party where the invitation indicates that there will be party favors and the favors for that guest will be marked with a sticker like one fixed to the invitation card. The guest is advised that the sticker contains a hidden symbol of a special kind and that the only way to see it is to locate a decoder which that guest will have to find at the party. Locating the decoder at the party can be a separate exercise to be taken as a game. After the guest has located his or her personal decoder he or she can determine which symbol belongs to that guest by using the decoder on the symbol on his or her invitation card. The guest then uses the decoding device to check the stickers on the party favors and determines which belongs to that guest. The decoding device can also be utilized with holiday gift giving. For example, with the camouflaged symbols, none of the children can determine which code belongs to them but also what code is on any present. At the appropriate unwrapping time, information is given to the children as to the location of a decoder which might be located on a particular ornament hanging on the Christmas tree. The decoder device as part of an ornament may be rehung on subsequent Christmases as a remembrance of holidays past. Each child can be given a card with information to allow that child to locate the decoder. Once having obtained his or her decoder, they can check their card to determine what symbol is fixed to their presents. Again, multiple symbols can be used for each child. The child then uses the decoder device to check each present, determining which are theirs and which do not belong to them. For example, one child's card may refer to a candy cane decoder and another child to a snowman decoder. Each child locates their separate decoders and then proceeds to discover the symbol on their particular card. That symbol need not have any reference to the decoder shape and is preferably a completely different symbol.

While this invention has been described with reference to the specific embodiments disclosed herein, it is not confined to the details set forth and the patent is intended to include modifications and changes which may come within and extend from the following claims.

I claim:

1. A method to aid children to identify their multiple gifts from the multiple gifts of others at a chosen time of giving, the method comprising:

(A) providing a first coding means comprising:

(i) a multiplicity of sheet members each comprising a front surface and a rear surface, (ii) adhesive means on each sheet to cause the rear surface to adhere to a gift, and (iii) first marking means visible on the front surface of each sheet making all the sheet members of the first coding means identifiable as single group to a child, (B) providing a second coding means comprising:

(i) a multiplicity of sheet members each comprising a front surface and a rear surface, (ii) second adhesive means on each sheet to cause the rear surface to adhere to a gift, and (iii) second marking means visible on the front surface of each sheet making all the sheet members of the second coding means identifiable as single group to a child and distinguishable from the first coding means, (C) providing first matching means comprising information that matches the first marking means with a first child, (D) providing second matching means comprising information that matches the second marking means with a second child, (E) adhering first coding means to at least a portion of gifts intended for the first child, (F) adhering second coding means to at least a portion of gifts intended for the second child, and (G) at the chosen time for giving the gifts delivering the first coding means to the first child and the second coding means to the second child.

2. The method of claim further comprising:

(A) providing a third coding means comprising:

(i) a multiplicity of sheet members each comprising a front surface and a rear surface, (ii) adhesive means on each sheet to cause the rear surface to adhere to a gift, and (iii) a third marking means visible on the front surface of each sheet making all the sheet members of the third coding means identifiable as single group to a child and distinguishable from all other coding means, (B) providing a fourth coding means comprising:

(i) a multiplicity of sheet members each comprising a front surface and a rear surface, (ii) adhesive means on each sheet to cause the rear surface to adhere to a gift, and (iii) a fourth marking means visible on the front surface of each sheet making all the sheet members of the fourth coding means identifiable as single group to a child and distinguishable from all other coding means, (C) providing third matching means comprising information that matches the third marking means with the first child, (D) providing fourth matching means comprising information that matches the fourth marking means with the second child, (E) applying third coding means to a balance of gifts intended for the first child, (F) applying fourth coding means to a balance of gifts intended for the second child, and (G) at the chosen time for giving the gifts delivering the third matching means to the first child and the fourth matching means to the second child.

3. The method of claim 2 further comprising:

(A) prior to the chosen time for receiving the gifts hiding the first, second, third and fourth matching means in separate locations, (B) providing first clue means comprising information with at least one clue that guides the first child to find the first matching means, (C) providing second clue means comprising information with at least one clue that guides the second child to find the second matching means, (D) providing third clue means comprising information with at least one clue that guides the first child to find the third matching means, (E) providing fourth clue means comprising information with at least one clue that guides the second child to find the fourth matching means, and (F) at the chosen time for giving the delivering the first and third matching means to the first child and the second and fourth matching means to the second child is accomplished by delivering the first and third clue means to the first child and the second and fourth clue means to the second child.

4. The method of claim 3 wherein the first, second, third, and fourth clue means each comprise cards that contain information as to where the respective matching means are located.

5. The method of claim 2 wherein the first, second, third, and fourth matching means each comprise cards that contain information identifying the marking means and matching it to a respective child.

6. The method of claim 2 wherein the adhesive means causes each sheet to adhere to a gift on contact, and the adhering comprises pressing the sheet members against a surface of the gift.

7. The method of claim 2 wherein each matching means comprises decoding means comprising a colored transparent filter and each coding means comprises a camouflaging pattern printed over the marking means making identification of the marking means essentially impossible with an unaided eye, wherein the hues of the camouflaging pattern and the color of the filter are the same and the hues of the marking means and the color of the filter are contrasting, and the method further comprises aligning the filter of the decoding means over coding means and identifying the coding means through the filter.

8. The method of claim 1 further comprising:

(A) prior to the chosen time for receiving the gifts hiding the first and second matching means in separate locations, (B) providing first clue means comprising information with at least one clue that guides the first child to find the first matching means, (C) providing second clue means comprising information with at least one clue that guides the first child to find the first matching means, and (D) at the chosen time for giving the delivering the first matching means to the first child and the second matching means to the second child is accomplished by delivering the first clue means to the first child and the second clue means to the second child.

9. The method of claim 8 wherein the first and second clue means each comprise cards that contain information as to where the respective matching means are located.

10. The method of claim 1 wherein the first and second matching means each comprise cards that contain information identifying the marking means and matching it to a respective child.

11. The method of claim 1 wherein the first and second matching means each comprise cards that contain information identifying the marking means and matching it to a respective child.

12. The method of claim 1 wherein the adhesive means causes each sheet to adhere to a gift on contact, and the adhering comprises pressing the sheet members against a surface of the gift.

13. The method of claim 1 wherein each matching means comprises decoding means comprising a colored transparent filter and each coding means comprises a camouflaging pattern printed over the marking means making identification of the marking means essentially impossible with an unaided eye, wherein the hues of the camouflaging pattern and the color of the filter are the same and the hues of the marking means and the color of the filter are contrasting, and the method further comprises aligning the filter of the decoding means over coding means and identifying the coding means through the filter.

14. The method of claim 1 wherein the sheet members are all paper or plastic film contact adhesively individually attached to and spaced apart on an adhesive releasable sheet, and applying coding means comprises peeling the sheets from the releasable sheet.

15. The method of claim 1 wherein the first matching means comprising a first card containing information that matches the first marking means with a first child also comprises an envelope, and the method further comprises affixing the first child's name on the outside of the envelope, inserting the first card into the envelope and sealing the envelope, the second matching means comprising a second card containing information that matches the second marking means with a second child also comprises an envelope, and the method further comprises affixing the second child's name on the outside of the envelope, inserting the second card into the envelope and sealing the envelope.

16. A method to aid children to identify their multiple gifts from the multiple gifts of others at a chosen time of giving, the method comprising:

(A) providing first coding means comprising:

(i) a multiplicity of sheet members each comprising a front surface and a rear surface, (ii) adhesive means on each sheet to cause the rear surface to adhere on contact to a gift, and (iii) a first marking means visible on the front surface of each sheet making all the sheet members of the first coding means identifiable as single group to a child, (B) providing second coding means comprising:

(i) a multiplicity of sheet members each comprising a front surface and a rear surface, (ii) second adhesive means on each sheet to cause the rear surface to adhere on contact to a gift, and (iii) a second marking means visible on the front surface of each sheet making all the sheet members of the second coding means identifiable as single group to a child and distinguishable from the first coding means, (C) adhering first coding means to at least a portion of gifts intended for the first child, (D) adhering second coding means to at least a portion of gifts intended for the second child, (E) providing first matching means comprising a card that contains information that matches the first marking means with a first child, (F) providing second matching means comprising a card that contains information that matches the second marking means with a second child, (G) prior to the chosen time for giving the gifts hiding the first and second matching means in separate locations, (H) providing first clue means comprising a card that contains information with at least one clue that guides the first child to find the first matching means, (I) providing second clue means comprising a card that contains information with at least one clue that guides the first child to find the first matching means, and (J) at the chosen time for giving the gifts delivering the first clue means to the first child and the second clue means to the second child.

17. A method to aid children to identify their multiple gifts from the multiple gifts of others at a chosen time of giving, the method comprising:

(A) providing a first coding means comprising:

(i) a multiplicity of sheet members each comprising a front surface and a rear surface, (ii) adhesive means on each sheet to cause the rear surface to adhere on contact to a gift, (ii) a first marking means on the front surface of each sheet making all the sheet members of the first coding means identifiable as single group to a child, and (iv) a camouflaging pattern printed over the first marking means making identification of the first marking means essentially impossible with an unaided eye, (B) providing a second coding means comprising:

(i) a multiplicity of sheet members each comprising a front surface and a rear surface, (ii) second adhesive means on each sheet to cause the rear surface to adhere on contact to a gift, (iii) a second marking means on the front surface of each sheet making all the sheet members of the second coding means identifiable as single group to a child and distinguishable from the first coding means, and (iv) a camouflaging pattern printed over the second marking means making identification of the second marking means essentially impossible with an unaided eye, (C) adhering first coding means to at least a portion of gifts intended for the first child, (D) adhering second coding means to at least a portion of gifts intended for the second child, (E) providing first matching means comprising:

(i) a card that contains information that matches the first marking means with a first child, and (ii) decoding means comprising a colored transparent filter, wherein the hues of the camouflaging pattern of the first coding means and the color of the filter are the same and the hues of the first marking means and the color of the filter are contrasting, (F) providing second matching means comprising:

(i) a card that contains information that matches the second marking means with a second child, and (ii) decoding means comprising a colored transparent filter, where the hues of the camouflaging pattern of the second coding means and the color of the filter are the same and the hues of the second marking means and the color of the filter are contrasting, (G) prior to the chosen time for giving the gifts hiding the first and second matching means in separate locations, (H) providing first clue means comprising a card that contains information with at least one clue that guides the first child to find the first matching means, (I) providing second clue means comprising a card that contains information with at least one clue that guides the first child to find the first matching means, and (J) at the chosen time for giving the gifts delivering the first clue means to the first child and the second clue means to the second child.

* * * * *